US010920521B2

(12) United States Patent
Turner et al.

(10) Patent No.: US 10,920,521 B2
(45) Date of Patent: Feb. 16, 2021

(54) SELF-CONTAINED WELL INTERVENTION SYSTEM AND METHOD

(71) Applicant: Saudi Arabian Oil Company, Dhahran (SA)

(72) Inventors: Robert John Turner, Dhahran (SA); Brett Bouldin, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/510,202

(22) Filed: Jul. 12, 2019

(65) Prior Publication Data

US 2021/0010342 A1 Jan. 14, 2021

(51) Int. Cl.
*E21B 33/072* (2006.01)
*E21B 33/038* (2006.01)
*E21B 43/30* (2006.01)

(52) U.S. Cl.
CPC ..... *E21B 33/072* (2013.01); *E21B 33/0385* (2013.01); *E21B 43/30* (2013.01)

(58) Field of Classification Search
CPC .... E21B 33/072; E21B 43/30; E21B 33/0385; E21B 33/068; E21B 33/076
See application file for complete search history.

(56) References Cited

U.S. PATENT DOCUMENTS 868,809 A * 10/1907 Rathbone ..... E21B 31/18 294/86.13
1,509,906 A * 9/1924 Sawtelle ..... E21B 33/072 184/15.1
3,602,300 A 8/1971 Jaffe
3,744,567 A * 7/1973 Grable ..... E21B 33/072 166/385
3,762,725 A 10/1973 Taylor
4,577,693 A 3/1986 Graser
5,143,353 A * 9/1992 Sano ..... G02B 6/4464 254/134.3 FT
5,848,646 A 12/1998 Huber et al.
6,059,042 A * 5/2000 Huber ..... E21B 34/102 166/377
6,863,124 B2 * 3/2005 Araux ..... F04D 13/024 166/66.4

(Continued)

FOREIGN PATENT DOCUMENTS

CN 107875674 4/2018

OTHER PUBLICATIONS

Huiquan Wang et al. Review: Porous Metal Fibers and Membranes for Oil-Water Separation. Nanoscale Research Letters. 2018, 13, 284 (14 pages).

(Continued)

*Primary Examiner* — James G Sayre
(74) *Attorney, Agent, or Firm* — Leason Ellis LLP

(57) ABSTRACT

A method for performing a well intervention operation includes the steps of: (a) sealingly coupling a lubricator onto an open top end of a well tree, the lubricator having a hollow interior in which a rotatable winch is contained, the winch having a cable wound thereabout; (b) attaching a tool to the cable; (c) lowering the tool within a well bore to which the well tree is attached; and (d) operating the winch from a location exterior to the lubricator to cause rotation of the winch and winding of the cable, whereby the tool is retrieved from the wellbore.

23 Claims, 7 Drawing Sheets

(56) References Cited

U.S. PATENT DOCUMENTS

| | | | | |
|---|---|---|---|---|
| 7,331,393 | B1 | 2/2008 | Hoel | |
| 7,331,394 | B2 | 2/2008 | Edwards et al. | |
| 8,672,037 | B2 | 3/2014 | Schuurman et al. | |
| 2003/0042019 | A1* | 3/2003 | Harkins | E21B 47/07 166/250.01 |
| 2007/0227741 | A1* | 10/2007 | Lovell | E21B 23/14 166/380 |
| 2010/0294479 | A1 | 11/2010 | Shee | |
| 2014/0174716 | A1* | 6/2014 | Talgo | E21B 33/037 166/65.1 |
| 2015/0258588 | A1 | 9/2015 | Moon et al. | |
| 2018/0178144 | A1 | 6/2018 | Lu et al. | |
| 2020/0131899 | A1* | 4/2020 | Chen | E21B 47/095 |

OTHER PUBLICATIONS

Yan Liu et al. Bioinspired structured superhydrophobic and superoleophilic stainless steel mesh for efficient oil-water separation. Colloids and Surfaces A: Physicochemical and Engineering Aspects. 2016, 500, 54-63.

Yan Liu et al. A Facile Electrodeposition Process for the Fabrication of Superhydrophobic and Superoleophilic Copper Mesh for Efficient Oil—Water Separation. Industrial & Engineering Chemistry Research. 2016, 55(10), 2704-2712.

Colin R. Crick et al. Superhydrophobic polymer-coated copper-mesh; Membranes for highly efficient oil-water separation. J. Mater. Chem. A. 2013, 1, 5943-5948.

International Search Report and Written Opinion in Corresponding PCT Application No. PCT/US2020/041362 dated Oct. 15, 2020. 10 pages.

* cited by examiner

SELF-CONTAINED WELL INTERVENTION SYSTEM AND METHOD

TECHNICAL FIELD

The present invention is directed to well intervention systems and methods and more particularly, according to one embodiment, relates to an extended tree cap that is configured for installation on top of a well tree and includes a self-contained reel or winch assembly that is configured to controllably deliver and retrieve tools or the like from the well. In yet another aspect, according to one embodiment, a tool is configured to be lowered within the well and capture an autonomous ball sensor that is contained within the well.

BACKGROUND

In petroleum and natural gas extraction, a Christmas tree, or "tree", is an assembly of valves, spools, and fittings used to regulate the flow of pipes in an oil well, gas well, water injection well, water disposal well, gas injection well, condensate well and other types of wells. The primary function of a tree is to control the flow, usually oil or gas, out of the well. It is a key piece of equipment for controlling the upper part of an oil & gas well and production adjustment.

As is well known, a well intervention, or well work, is any operation carried out on an oil or gas well during, or at the end of, its productive life that alters the state of the well or well geometry, provides well diagnostics, or manages the production of the well. At some point in the life of all oil and gas wells, parts will require maintenance, repair or replacement. At these times, operators turn to intervention specialists. Interventions generally fall into two general categories: light or heavy. During light interventions, technicians lower tools or sensors into a live well while pressure is contained at the surface. In heavy interventions, the rig crew may stop production at the formation before making major equipment changes.

Well service personnel typically perform light interventions using slickline, wireline, or coiled tubing. These systems allow operators to minimize the possibility of potential well blockages. Operators also order light interventions to change or adjust downhole equipment such as valves or pumps, or to gather downhole pressure, temperature, and flow data. Heavy interventions (also referred to as workovers) require the rig crew to remove the wellhead and other pressure barriers from the well to allow full access to the wellbore. These operations require a rig to remove and reinstall the wellhead and completion equipment.

Accordingly, slickline and electricline are considered to be preferred forms of well intervention. A slickline is a thin cable introduced into a well to deliver and retrieve tools downhole, while a wireline is an electrical cable used to lower tools into and transmit data about the conditions of the wellbore. Usually consisting of braided cables, wirelines are used to perform wireline logging. As is known, the oil and gas industry uses wireline logging to obtained a continuous record of a formation's rock properties. Wireline logging is thus the acquisition and analysis of geophysical date performed as a function of wellbore depth, together with the provision of related services.

Slicklines can thus be used to place and recover wellbore equipment, such as plugs, gauges and valves, slicklines are single-strand non-electric cables lowered into oil and gas wells from the surface. Slicklines can also be used to adjust valves and sleeves located downhole, as well as repair tubing within the wellbore. A slickline can be wrapped around a drum on the back of a truck, the slickline is raised and lowered in the well by reeling in and out the wire hydraulically. Consequently, a truck is required to be delivered to the well site. Wirelines on the other hand, wirelines are electric cables that transmit data about the well. Consisting of single strands or multi-strands, the wireline is used for both well intervention and formation evaluation operations. In other words, wirelines are useful in gathering data about the well in logging activities, as well as in workover jobs that require data transmittal.

A wireline operation requires the use of several pieces of equipment for controlled delivery and retrieval of the wireline (slickline/electricline). For example, a slickline or electricline is often used with a lubricator which is a term initially applied to the assembly of pressure-control equipment used on slickline operations to house the tool string in preparation for running into the well or for retrieval of the tool string on completion of the operation. The lubricator is assembled from sections of heavy-wall tube generally constructed with integral seals and connections. Lubricator sections are routinely used on the assembly of pressure-control equipment for other well-intervention operations.

Another common component is a stuffing box that is specifically designed to seal around the solid wireline (slickline) to confine wellbore fluids and gases within the surface pressure equipment. This allows wireline (slickline) operations to be carried out under pressure. The stuffing box can be operated either manually or hydraulically without part modifications.

FIG. 1 shows a conventional slickline rig-up 10 above a wellhead 20. The rig-up 10 generally includes a slickline winch (not illustrated) which include a spool about which a cable 5 is wound about. There are many types of winches including but not limited to stationary, skid-mounted, truck mounted, etc. The cable 5 can take any number of different forms including but not limited to being a monofilament, a wire, wireline, slickline, fiber optic, tubing, etc., and thus, for the purpose of this application the term "cable" covers any of these types of structures as well as other suitable ones. The cable 5 can be solid piano wire, although sometimes braided line is used. There is normally no conductor in the line and hence the term "slick" or solid and smooth line. The rig-up 10 also includes a bottom sheath 30 and a top sheath 32 with the cable 5 being routed from the winch to the bottom sheath 30 and then up to the top sheath 32. From the top sheath 32, the cable 5 is routed into a seal control head (or stuffing box) 40 and then a lubricator 42 which is below the seal control head 40. A number of other tubular structures are located below the lubricator 42 through which the cable 5 passes. A tool trap 50 and bleed-off sub 52 can extend outwardly (perpendicular) from the tubular structures. A single or double ram blow out preventer (BOP) 60 is located below the tubular structures and is configured to mate with a wellhead adapter flange 70. It will therefore be appreciated that the slickline rig-up 10 involves a number of components to ensure proper routing of the cable 5 from the external winch up to the entry point (seal control head).

As a result of the above components and arrangement of the tree, slickline and electricline operations must be manned 24 hrs a day for all seven days of the week since with a slickline and an electricline, the umbilical (cable) is too large and the tree valve cannot close. This is why 24/7 monitoring is required to ensure proper and safe operation of the system.

As described herein, the present invention offers an improved alternative well intervention system and method that eliminates many of the components required in the slickline rig-up 10 of FIG. 1.

SUMMARY

In one aspect of the present invention, a self-contained well intervention lubricator is provided for attachment to a well tree. The lubricator has a lubricator body having a first closed end and an opposite open end that is for sealingly being coupled to one end of the well tree for closing off the well tree. The lubricator body has a hollow interior that functions as a pressurized chamber. A rotatable winch is disposed within the hollow interior and a cable is wound about the winch. The winch is coupled to an external part that is configured to rotate the winch and is located external to the lubricator body. The winch being coupled to the external part through a sealed opening formed in a side wall of the lubricator body.

In another aspect, a method for performing a well intervention operation comprises the steps of:

sealingly coupling a lubricator onto an open top end of a well tree, the lubricator having a hollow interior in which a rotatable winch is contained, the winch having a cable wound thereabout;

attaching a tool to the cable;

lowering the tool within a well bore to which the well tree is attached; and operating the winch from a location exterior to the lubricator to cause rotation of the winch and winding of the cables, whereby the tool is retrieved from the wellbore.

BRIEF DESCRIPTION OF THE DRAWING FIGURES

DETAILED DESCRIPTION OF CERTAIN EMBODIMENTS

As will be described herein, the present invention is directed to well intervention systems and methods and more particularly, according to one embodiment, relates to an extended tree cap that is configured for installation on top of a well tree and includes a self-contained reel or winch assembly that is configured to controllably deliver and retrieve tools or the like from the well. In yet another aspect, according to one embodiment, a tool is configured to be lowered within the well and capture an autonomous ball sensor that is contained within the well.

As described herein, the present system is a "self-contained" system in that a reel or winch element about which the wire is wound is contained internally within the hollow body of the extended tree cap (lubricator) of the present invention. This is in direct contrast to prior art systems in which, as described above, the winch or reel is located external to the well intervention equipment (tree) and is typically truck mounted or part of a stationary piece of equipment located external to the tree.

Figure 2:
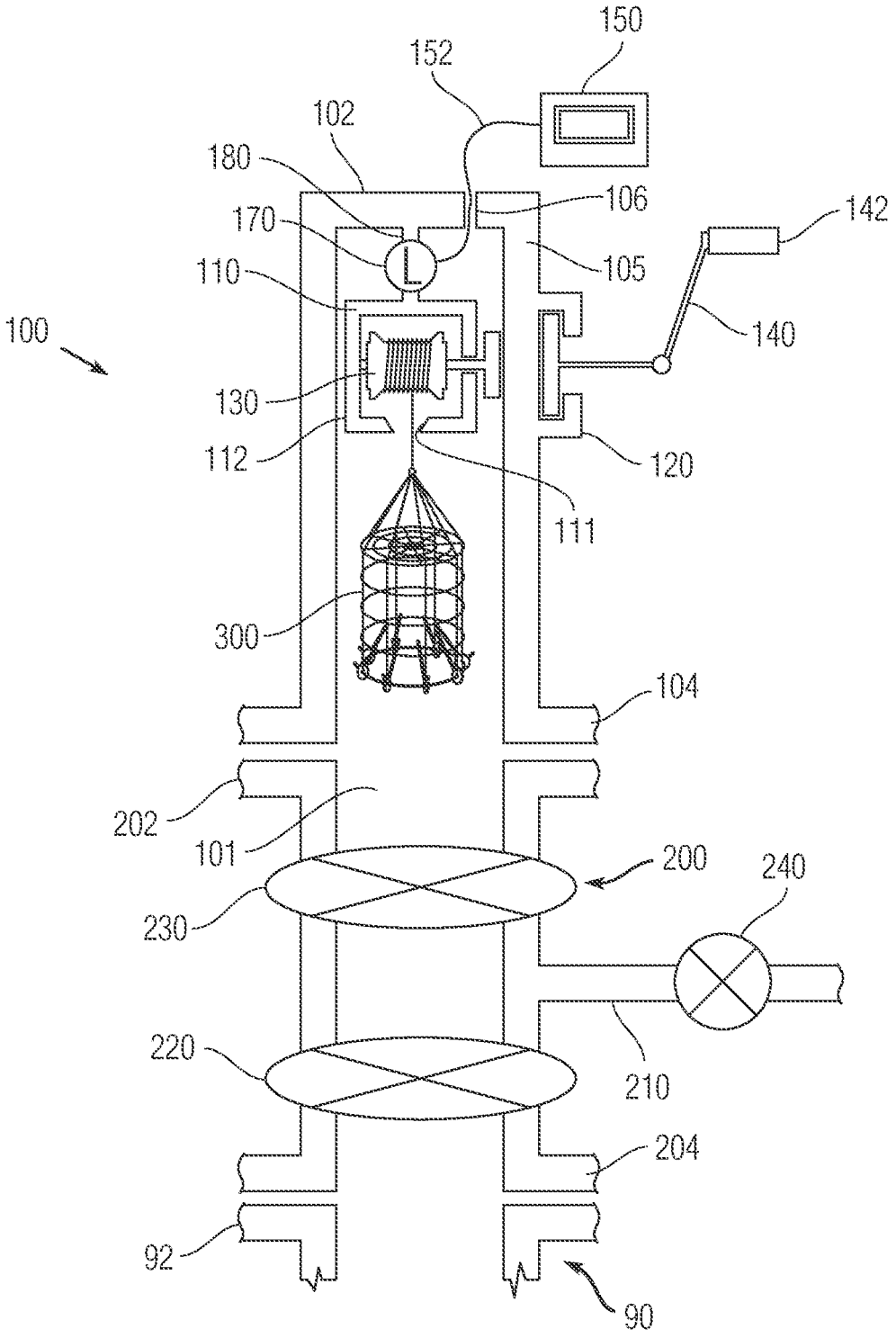
FIG. 2 is a side cross-sectional view of a well intervention system in accordance with one embodiment of the present invention.

FIG. 2 is a general schematic showing features and components of a well intervention system (extended tree cap) 100, according to one exemplary embodiment, that is configured to mate with a traditional wellhead 90 and more particularly, the system 100 is intended to mate with a tree (Christmas tree) 200 that is secured to (on top of) of the wellhead 90. FIG. 2 only shows a top portion of the wellhead 90 that mates with the tree 200. It will be appreciated that the wellhead 90 and tree 200 can take any number of different forms so long as they are suitable for use with the system 100 of the present invention. As previously discussed, the wellhead 90 is the component at the surface of the well that provides the structural and pressure containing interface for the drilling and production equipment. The top portion of the wellhead 90 is shown as a hollow tubular structure with a top flange 92 that interfaces with the tree 200 as described below.

As is known, the tree (Christmas tree) 200 is referred to as a series of valve & spool assembly fitted on top of the well. The tree 200 is installed on top of the last casing spool on a surface well or the high-pressure wellhead housing (wellhead 90) for a subsea well.

Figure 1:
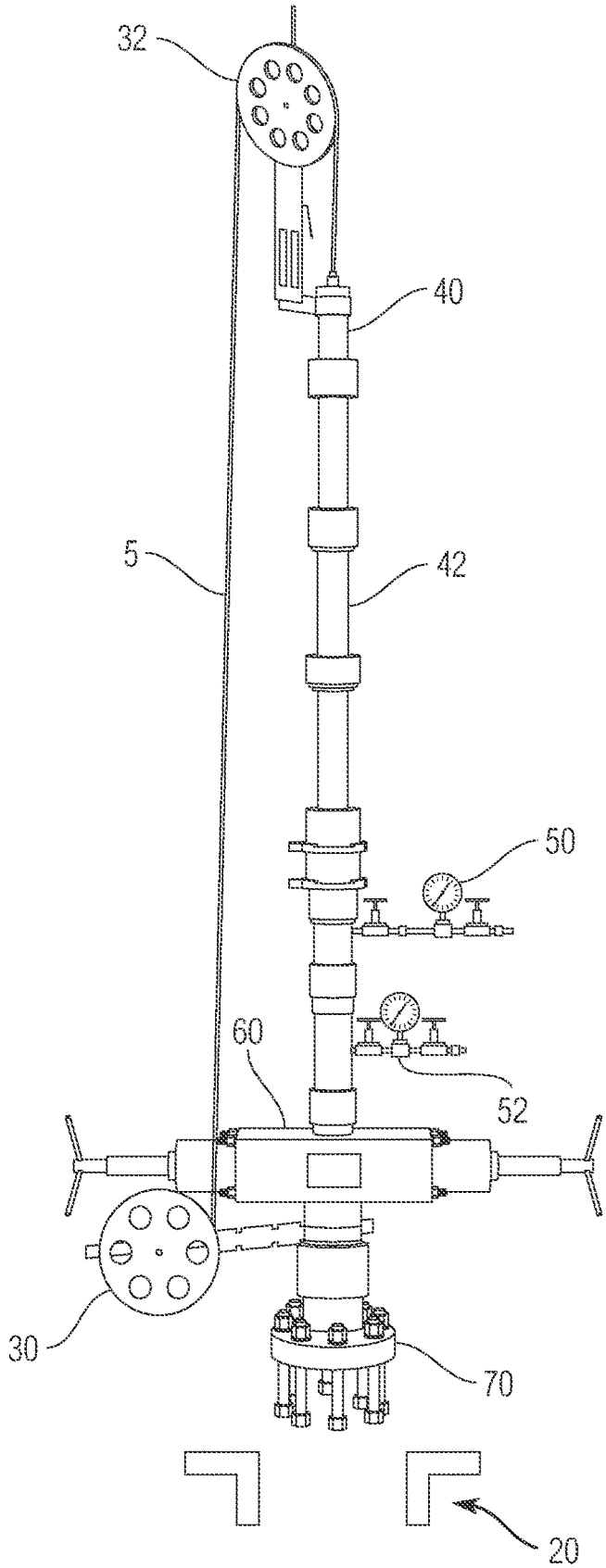
Prior Art Fig. 1
FIG. 1 is a side perspective view of a conventional slickline well intervention system.

FIG. 1 demonstrates the diagram of the Christmas tree 200 and wellhead 90. The Christmas part (tree 200) is located as the top part and the wellhead part 90 is the lower section. The Christmas tree 200 has a first end 202 and a second end 204 with the second end 204 sealingly mating with top flange 92 of the wellhead 90.

The Christmas tree 200 has the following functions: (1) allow reservoir fluid to flow from the well to the surface safely in a controlled manner; (2) allow safe access to the wellbore in order to perform well intervention procedures; (3) allow injections as water or gas injection; (4) provide access to hydraulic line for a surface control sub surface safety valve (SCSSSV); and (5) provide electrical interface for instrumentation and electrical equipment for electrical submersible pump (ESP).

FIG. 2 only shows certain components of the tree 200 for illustrative purposes. More particularly, the tree 200 includes one or more wing sections 210 that extend radially outward from the main hollow body of the tree 200. In FIG. 2, one wing section 210 is shown; however, other wing sections can be provided.

The tree 200 includes a master valve 220 located below the wing section 210 proximate the second end 204 that mates with the wellhead 90. As is known, the master valve 220 functions to allow the well to flow or shut the well in. There can be two master valves 220; however, for simplicity, there is only one master valve 220 shown in FIG. 2. Two valves (lower and upper master valves) are often used because they provide redundancy. If one master valve 220 cannot function properly, another valve can perform the function.

The tree 200 also includes a swab valve 230 that can be located within the tree 200 above the wing section 210. On the Christmas tree 200, the swab valve 230 is the topmost valve within the tree 200 providing vertical access to the well for well intervention operations conducted by wireline, slickline, coiled tubing or a snubbing unit.

The tree 200 further includes a wing valve (flowing wing) 240 that is located within the wing section 210 and thus is located on the side of the Christmas tree 200 and it is used to control or isolate production from the well into surface facilities. Depending on each design of the Christmas tree 200, it can be equipped with one (as shown) or two wing valves 240. Some operators require two production wing valves, one as a main production and another one as a backup. In many cases, one wing valve is used for production and another wing valve is used as a kill wing valve.

Conventional techniques are used to mount the tree 200 to the wellhead 90 and since both the tree 200 and wellhead 90 are hollow tubular structures, a common, continuous pathway (bore) is formed.

In accordance with the present invention, the extended tree cap 100 is configured to interface with the tree 200 and serves as a cap since it closes off the open first end 102 of the tree 100. The cap 100 has a body 105 that defines a hollow interior 101 and includes a closed first (top) end and an opposite open second (bottom) end 104 that interfaces with the first end 202 of the tree 200. A top wall at the first end 102 thus closes off the cap 100 with the exception that a through hole 106 can be formed through the top wall at the first end 102. The through hole 106 is formed vertically and is open to the outside and is open to the hollow interior 101. The through hole 106 is used to route equipment, or parts thereof, from the exterior to the inside (hollow interior 101) of the cap 100 as will be described in more detail herein.

As with the arrangement between the tree 200 and the wellhead, the hollow interior 101 is in fluid communication with and forms a continuous pathway (bore) with the hollow interiors of the tree 200 and wellhead. The diameters of the cap 100, tree 200 and upper portion of the wellhead can be the same or similar or one or more of these sections can have different diameters.

As discussed herein, the cap 100 functions as the lubricator of the well intervention system and operates under pressure.

Within the hollow interior 101, a reel or winch housing is provided and is defined by a top wall 110 that extends at least partially across the hollow interior 101 and a bottom wall 112 that extends at least partially across the hollow interior 101. The top wall 110 and bottom wall 112 can be parallel to one another. A first side of the housing can be closed off in that a side wall can extend between the top wall 110 and the bottom wall 112. The side wall can thus be located parallel to the body 105 of the cap 100. An opposite second side of the housing can be open. The housing can be anchored and suspended within the hollow interior 101 using any number of conventional techniques including the use of fasteners for securely attaching the housing to the inner surface of the body 105. The side wall of the body 105 can include a second through hole that is axially aligned within the inside of the winch housing.

Along the outer surface of the body 105 there can be external housing 120. The external housing 120 includes a hollow interior space and can include an outer wall that has a center opening that leads into the hollow interior space and is axially aligned with the second through hole formed in the body 105.

The reel or winch housing is thus fully contained within the hollow interior 101 of the cap 100, with the external housing being externally located. In direct contrast to conventional positioning of the winch assembly outside of the tree, the winch assembly of the present invention is placed inside the cap 100 which, as mentioned, operates as the lubricator and operates under pressure.

The reel or winch housing is configured to hold a reel or winch 130. The winch 130 comprises a rotatable spool about which the cable 5 is wound. The winch 130 is thus rotatably mounted within the winch housing. Much like a fishing reel, the winch 130 allows for storage of the cable 5 which is wound about the winch 130.

The bottom wall 112 includes an opening or hole 111 that accommodates the cable 5 and in particular, allows the cable 5 to travel from the winch 130 through the hole 111 into the hollow interior 101 below the bottom wall 112 of the winch housing. It will also be appreciated that the bottom wall 112 can act as a stop in that when a tool is raised, the upmost position of the tool would be when the tool is in the raised position in contact with the bottom wall 112. The winch 130 is thus oriented in a transverse direction across the housing and hollow interior 101, thereby allowing the cable 5 to hang straight down from the winch 130.

A shaft 132 is operatively coupled to the winch 130 as described herein and can be connected at one end of the winch and extends through the second through hole formed in the body 105. The shaft 132 thus passes into the interior of the external housing 120 and is thus rotatably mounted such that rotation of the shaft 132 causes direct rotation of the winch 130 (rotation in a first direction lowers the cable 5 and rotation in a second direction raises the cable 5). An outer end of the shaft 132 is connected to a handle 140 that can include a finger grip or bar 142. The handle 140 is intended to be grasped by the user and rotation of the handle 140 causes direct rotation of the winch 130 and the lowering or raising of the cable 5. It will be readily understood that the handle is located external to the tree cap 100 and thus, while the winch 130 is located internally within the tree cap 100, the handle 140 which controls operation is located external to the tree cap 100.

It will also be understood that instead of having handle 140, the shaft 132 of winch 130 can be operatively coupled to a motor (not shown) via a drive shaft or the like for controllably rotating the winch 130. The motor is thus disposed external to the tree cap 100 while the winch 130 remains self-contained and located within the hollow space 101 of the cap 100. The motor can be located proximate the cap 100 and can even be mounted to the exterior of the cap 100 or the motor can be located at a more remote location. In addition, it will be understood that a transmission can be used to couple the motor to the shaft 132. The transmission can be formed of several gears with one gear associated with shaft 132 and the other gear associated with the drive shaft of the motor so as to transmit rotation of the motor drive shaft into rotation of the shaft 132.

Figure 4:
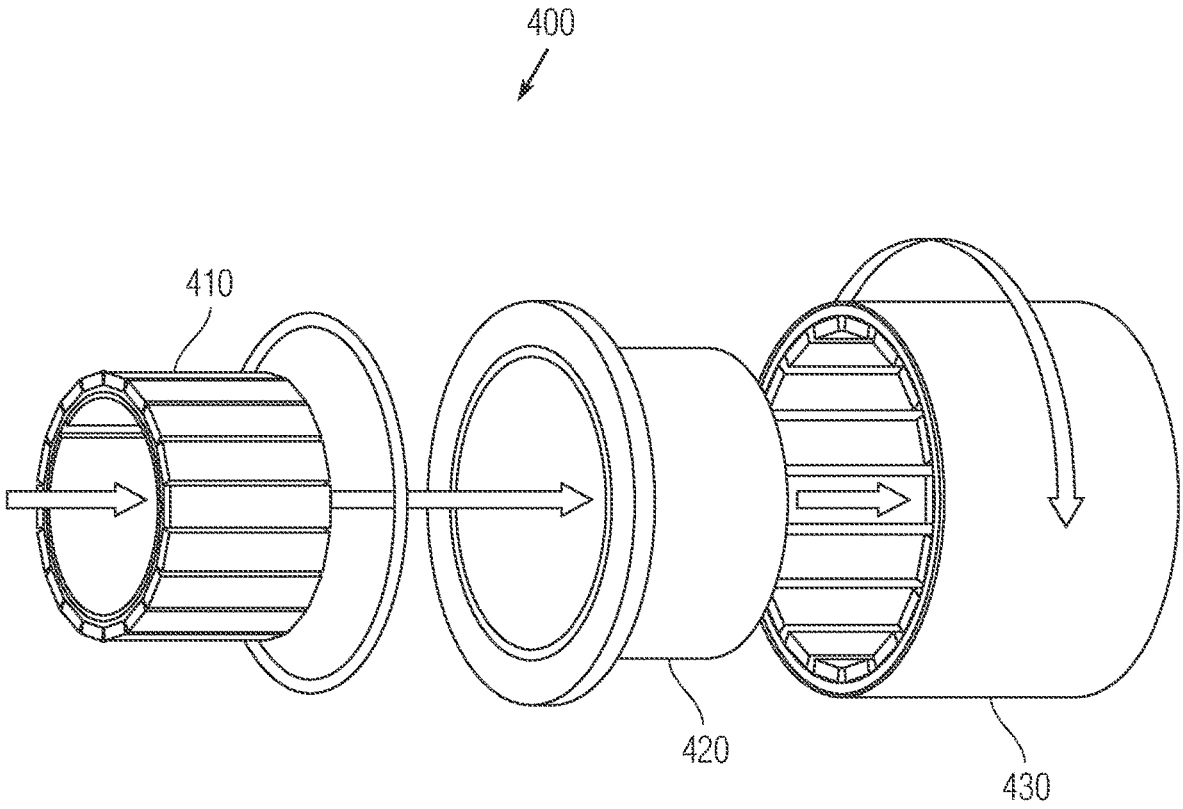
FIG. 4 is a side perspective view of a magnetic coupling that is used in a non-conductive self-contained well intervention system of the present invention.

When the cable 5 is a non-conductive wire as in a slickline application, a magnetic coupling 400 shown in FIG. 4 can be used and allows the winch (reel) 130 to be rotated through the pressure vessel wall (i.e., body 105 of cap 100). The magnetic coupling 400 as constructed does not use any dynamic seals which is one advantage to this arrangement. As is known, a magnetic coupling, such as magnetic coupling 400, is a coupling that transfers torque from one shaft to another, but using a magnetic field rather than a physical mechanical connection . . . . Magnetic shaft couplings preclude the use of shaft seals, which eventually wear out and fail from the sliding of two surfaces against each another.

In the embodiment of FIG. 4, as well as in view of FIG. 2, the magnetic coupling 400 includes an external coupling half 430 (e.g., hand crank or motor side) and an internal coupling half 410, 420 (e.g., winch side). More specifically, the external coupling half 430 is in the form of an outer magnetic hub 430 that includes a number of magnets arranged circumferentially. The internal coupling half is formed of an inner magnetic hub 410 and a containment barrier 420 that is disposed between the outer magnetic hub 430 and the inner magnetic hub 410. In this way, rotation of the outer magnetic hub 430 as by rotation of handle 140 or operation of a motor causes the non-contact rotation of the inner magnetic hub 410 that is disposed internally within the outer magnetic hub 430 (with barrier 420 disposed therebetween). Once again, it will be appreciated that a magnetic coupling arrangement is only applicable to slickline applications and not electricline applications in which rotation and electrical signals are needed under pressure.

Figure 5:
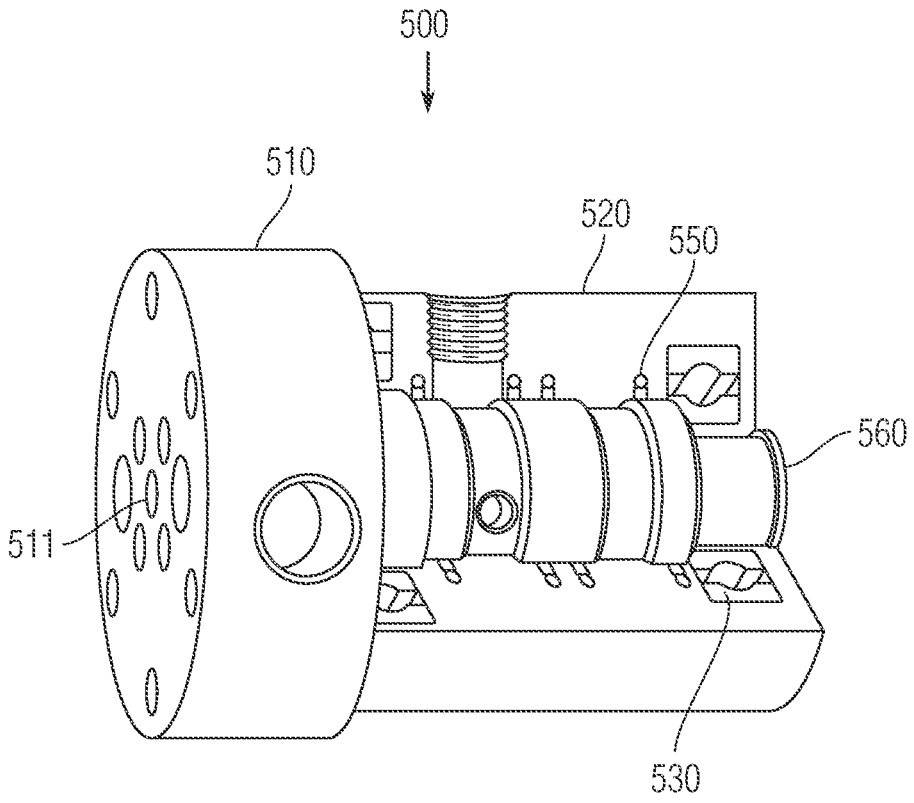
FIG. 5 is a side perspective view in partial cross-section of a rotary electrical union that is used in a conductive self-contained well intervention system of the present invention.

Thus, when cable 5 is an electricline, a rotatory electric union 500, illustrated in FIG. 5, can be used instead of the magnetic coupling 400. As is known, rotary union 500 is a union that allows for rotation of the unified parts, typically the housing and a shaft. FIG. 5 shows one exemplary rotary union 500 as well as the components thereof. The traditional components needed to make a rotary union are: a shaft 510, a housing 520, bearings 530, seals 550 and a retaining clip or ring 560. The shaft 510 has a through bore 511 that allows for passage of one or more elements. The illustrated union 500 can handle two electrical signals; however, there are other rotary electrical unions available that can carry a single signal or three of more signals. The rotary electrical union 500 does have rotary dynamic seals.

As mentioned, in electricline, a braided line can contain an inner core of insulated wires which provide power to equipment located at the end of the cable, normally referred to as electric line, and provides a pathway for electrical telemetry for communication between the surface and equipment at the end of the cable.

A load cell 170 is provided within the hollow interior 101 of the cap 100 above the top wall 110 and can be connected to a load cell display 150 with an electrical cable or wire 152 that passes through the through hole 106. Load cell 170 is a transducer that is used to create an electrical signal whose magnitude is directly proportional to the force being measured. In the present application, the load cell 170 is used to detect the tension on the line 5 as the tool is run and retrieved from the well. In particular, the load cell 170 is a sensor component in a weight indicator system that detects the tensional or compressional forces being imparted to the running wire at surface. Load cells are traditionally hydraulically or electronically operated and are connected to the weight indicator display 150 that can be part of an equipment operator's console.

The present invention provides two different methods for well intervention that provide numerous advantages over the previous well intervention methods that incorporate both slickline (FIGS. 2 and 4) and electricline technology (FIGS. 2 and 5).

Non-Conducting Self-Contained Intervention (FIGS. 2 and 4)

With reference to FIGS. 2 and 4, a non-conducting self-contained well intervention method incorporates the equipment shown in FIGS. 2 and 4.

The cable 5 and operation of the system can be similar to a traditional slickline application and the cable 5 can be formed from any number of suitable material, including but not limited to, nylon monofilament, polyethylene braided, crystalline fluorocarbon wire, etc. As mentioned with reference to FIG. 4, the magnetic rotary coupling 400 is provided and configured to rotate the winch 130 to permit rotation of the winch 130, which is self-contained within the cap 100, while operation of the winch 130 occurs outside the cap 100 which operates as a lubricator as well. However, unlike traditional slickline systems, no dynamic seals are needed and the following traditional elements have been eliminated: stuffing box, top sheave, bottom sheave, BOP, and no wireline truck or exterior winching unit.

As mentioned, a stepper motor or the like can be added external to the magnetic rotary coupling 400 to automate the rotation of the winch (reel) 130.

Figure 3:
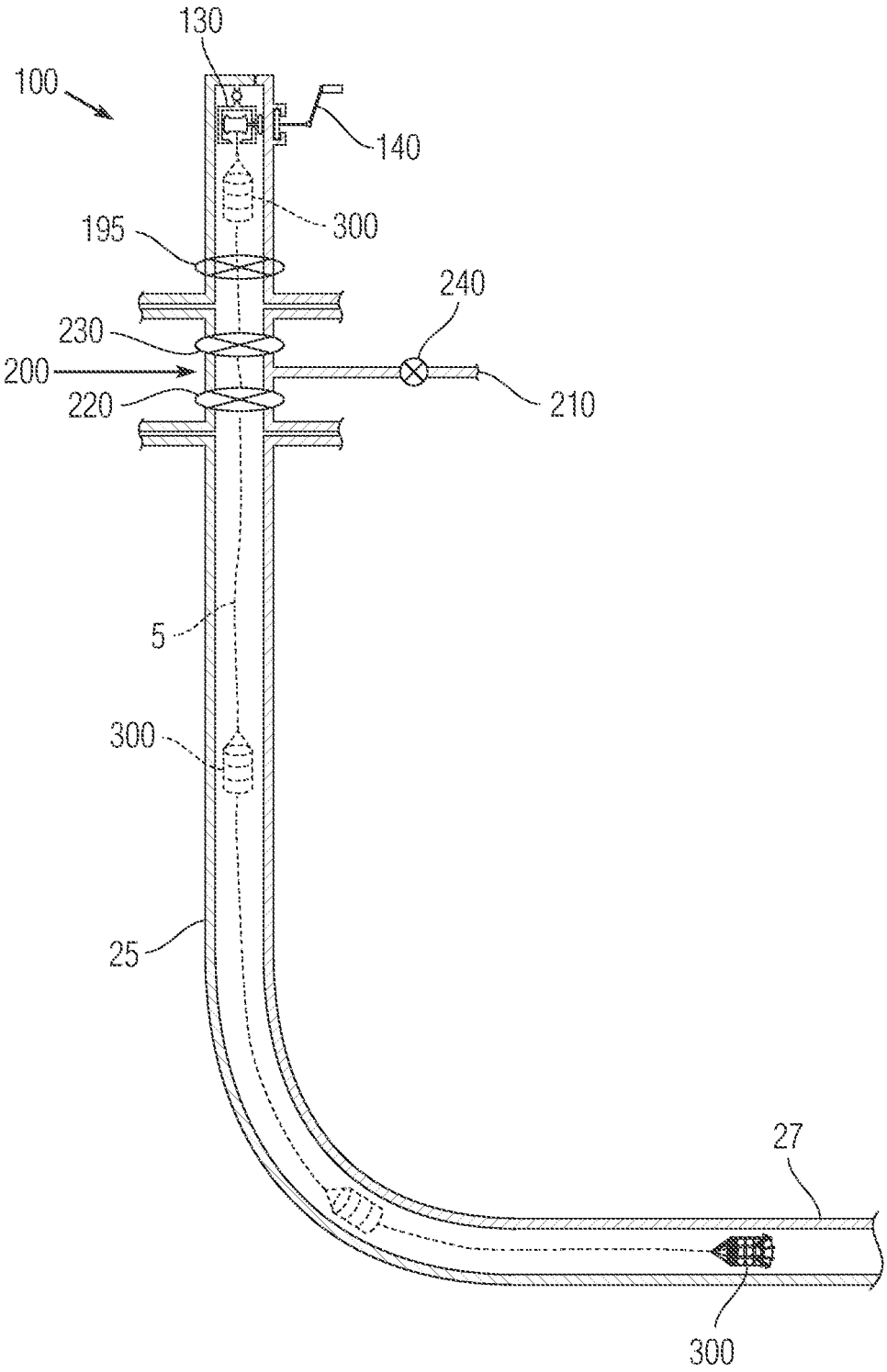
FIG. 3 is a side cross-sectional view of a well with a tree and the well intervention system of FIG. 2.

A tool, such as tool 300, is added to the working of the line 5. The tool 300 can be any number of suitable types of tool including but not limited to logging or fishing tools. Unwinding and winding of the cable 5 permits the tool 300 to be positioned at a desired location within the wellbore. FIG. 3 shows an exemplary wellbore with a first section 25 and a second section 27 that can be curved relative to the more vertically oriented first section 25.

The tool 300, which can be a logging tool, can descend the wellbore by gravity and can even travel into the second section 27 which is curved and generally travels in a transverse (horizontal) direction relative to the first section 25. As the tool 300 travels by gravity, the cable 5 is unwound from the winch 130. When the operator wants to retrieve the tool 300, the winch 130 is operated so as to begin winding of the cable 5 about the winch 130. This results in the tool 300 being pulled upwardly within the wellbore.

As discussed herein, FIGS. 2, 3 and 4 depict a slickline application in which the cable 5 comprises a non-conductive wire.

The load cell 170 detects the tension on the line 5 as the tool 300 is run and retrieved from the well (wellbore).

As also mentioned, the cap 100 functions as a lubricator for the cable 5 and can include a lubricator valve that can be used to test the tree valve seals.

In addition, a lubricator quick connect can be used to quick disconnect and reconnect the cap (lubricator) 100 to the tree 200. Any number of quick connect mechanisms can be used to connect second end 104 to end 202 of tree 200.

Conducting Self-Contained Intervention

In yet another embodiment, the present invention provides a conducting self-contained intervention system and method as best depicted in FIGS. 2, 3 and 5.

This system operates similar in function to electricline and wireline applications in well intervention technology. The cable 5 can be a single or dual conductor insulated wire which permits signals to be carried along cable 5.

Like the previous embodiment, many of the traditional components of a slickline or electricline system are eliminated. For example, in the conducting self-contained intervention system, the stuffing box and sheaves are eliminated and the rotary electrical union 500 is used to rotate the winch 130 on the inside of cap (lubricator) 100 from the outside of the cap (lubricator) 100. Only the rotary seal in the union 500 is dynamic, while the other parts are not.

The union 500 provides the required electrical connection between the rotary electrical union 500 and the cable 5 wound on the winch 130. This illustrated arrangement provides a rotating electrical connection that is on at all times. As previously mentioned, a stepper motor can be added externally to the rotary electrical union 500 to automated the rotation of the winch 130.

The load cell 170 detects the tension on the line 5 as the tool 300 is run and retrieved from the well (wellbore).

As also mentioned, the cap 100 functions as a lubricator for the cable 5 and can include a lubricator valve that can be used to test the tree valve seals.

In addition, a lubricator quick connect can be used to quick disconnect and reconnect the cap (lubricator) 100 to the tree 200. Any number of quick connect mechanisms can be used to connect second end 104 to end 202 of tree 200.

Advantages of the Present System

The present invention has a number of advantages over traditional slickline and electricline operations including but not limited to the following: 1) the present invention is smaller, lighter and cheaper to purchase and operate; 2) safer: there are not dynamic seals in the non-conductive version and 1-2 rotary seals in the electrical version (with the rotary electric union) with no stuffing box (dynamic seal) required; 3) no 24/7 monitoring with manpower (if the line (cable 5) is small and flexible enough the swab and mater valves can be made to seal on the line while it is handing through the well tree and the line (cable 5) can be cut or not cut by the valves so long as the valves seal; 4) logging could be easily automated (the lubricator end cap 100 can be mounted to the well tree 200 for extended periods of time—the well could be automatically logged every week with no rig-up, rid-down or operations costs; and 5) numerous pieces of equipment are eliminated from a traditional slickline operation and more particularly, no wireline/slickline BOP, no sheaves, no stuffing box, no wireline truck or winching unit, winds is reduced in size and placed inside the lubricator and operates under pressure.

Exemplary Tool for Retrieving Autonomous Ball Sensor

FIGS. 6A-6C and 7 illustrate tool 300 in accordance with one embodiment. The tool 300 is configured to be attached to cable 5 and travel within the well in that the tool 300 can be lowered and raised within the well using the winch 130 which winds and unwinds the cable 5. The tool 300 is configured to capture an autonomous ball sensor 370 that is located within the well.

The tool 300 has a frame that is defined by a plurality of vertical support members 310 that are circumferentially arranged and oriented in a vertical direction and spaced apart from one another and are connected via circumferential supports so as to define a cage. The cage (frame) has a top closed end that is attached to the cable 5 and an opposite bottom end that has an opening 360 that can receive the ball sensor 370 as described herein. The illustrated cage has a cylindrical shape and the vertical support members 310 can be cage wires that are connected to form a cage that has openings formed between the vertical support member 310.

Figure 6C:
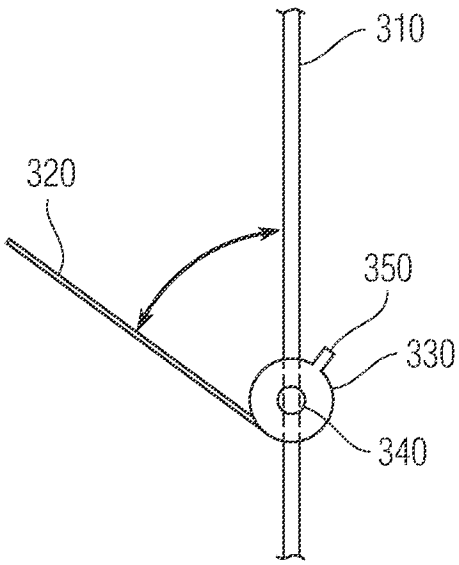
FIG. 6C is a schematic showing the biasing element pivotally coupled to the frame with the relative movement of the biasing element being shown with an arrow.
Figure 6A:
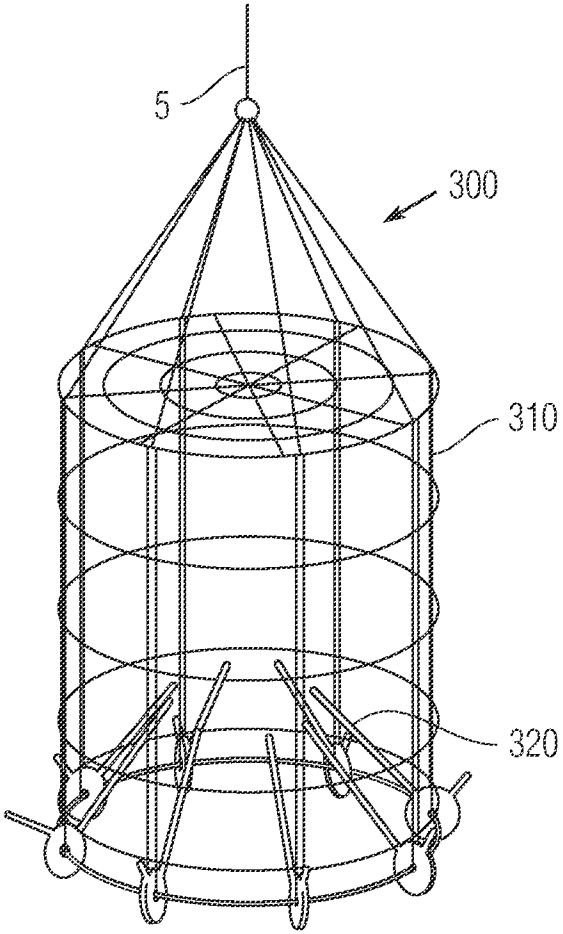
FIG. 6A is a side perspective view of a tool for capturing an autonomous ball sensor that travels within a well.
Figure 6B:
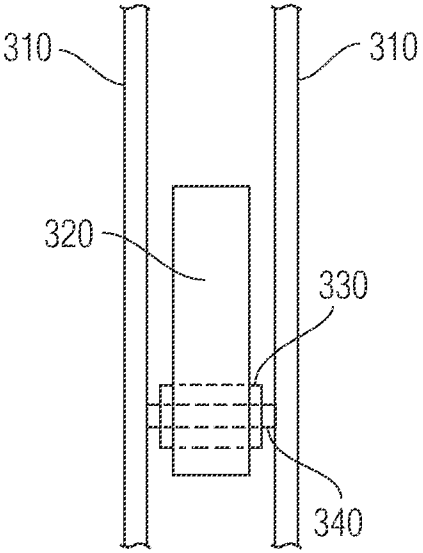
FIG. 6B is a cross-sectional view showing one biasing element coupled to a fame of the tool of FIG. 6A.

The frame has a plurality of pivotally biasing elements 320 that can also be arranged circumferentially and in particular are arrange circumferential about the opening 360. The biasing element 320 moves between a normal lowered position and a raised position when a force is applied thereto. As shown in FIG. 6C, each biasing element (e.g., leaf spring) can be in the form of an elongated leaf spring that has an inner first end that is disposed internally within the interior of the cage and an outer second end that is pivotally attached to a respective vertical support member 310 (vertical frame member). For example, the outer second end can be attached to a hub 330 that pivots about an axle 340. The stop 350 can be integrally formed with the hub 330. As shown in FIG. 6B, the axle 340 extends and is connected at its ends to two adjacent vertical support members 310. In this way, each vertical support member 310 is located between two adjacent vertical support members 310. A stop 350 limits the pivoting movement of the leaf spring 320 in that when the stop 350 contact the slat 310, the leaf spring's movement is limited.

Figure 7:
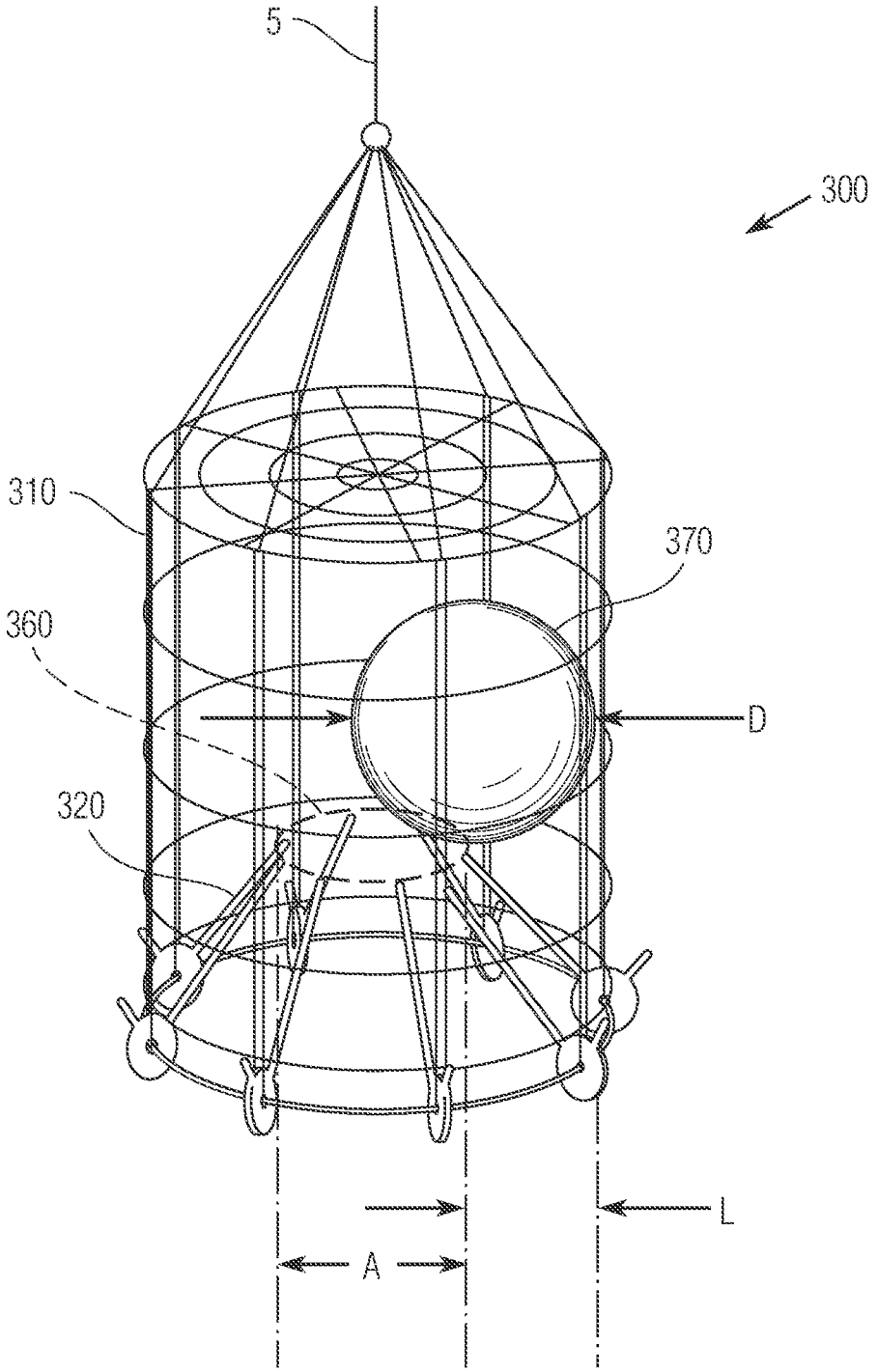
FIG. 7 is a side view showing the tool of FIG. 6A with the autonomous ball sensor being captured within the interior of the tool.

As shown in FIG. 6C, the biasing elements 320 are normally in the lowered position so as to define a minimum diameter for opening (diameter A). The vertical support members 310 are angled upward as shown in that the hub 330 and axle 340 are located below the inner first end of the vertical support member. The relative dimensions of the ball sensor 370 and the hole diameter 360 and the width of a perimeter annular shaped lip (L) are shown in FIG. 7. In FIG. 7, L is much greater than D and A is greater than D.

When the ball sensor 370 is initially brought into contact with the bottom end of the cage, the ball sensor 370 can pass through the opening 360 so as to be captured within the frame; however, the caught ball sensor 370 cannot escape back out much like how a fish trap works. Preferably, the dimension (L) is significantly greater than the width (diameter) of the opening 360. The arrow in FIG. 6C shows the pivoting movement of the leaf spring 320 from its naturally lowered position in which the diameter of the opening 360 is at its narrowest to an outwardly pivoted position in which the diameter of the opening 360 is at it widest. In the lowered position, the stop 350 can be in engagement with the cage frame to prevent further downward movement of the leaf spring 320.

In one embodiment, the force of the ball sensor 370 against at least some of the leaf springs 320 causes the outward pivoting of the leaf spring 320 toward the frame (vertical supports 310) and thereby result in enlargement of the opening 360 to allow passage of the ball sensor 370 through the opening 360. However, once the ball sensor 370 clears the leaf springs 320, the force applied to the leaf springs 320 is removed and the biasing action of the leaf springs 320 results in the leaf springs 320 moving back to their lowered position, thereby reducing the diameter of the opening 360 to the original diameter which causes the ball sensor 370 to be captured. Once the ball sensor 370 is captured within the interior of the frame (cage), the tool 300 is then pulled up by cable 5.

It will be appreciated that the tool(s) can be easily retrieved with the present invention. Alternatively, the one or more tools can be left and the cable (line) 5 can be retrieved. In addition, the tools can retrieve other tools left in the well. Surface safety valves can sever the line (cable 5) or close on the line so long as the valves can operate normally and seal the passage (bore).

One advantage discussed herein is that when the cable 5 is a conductor wire (electricline), the conductor (wire) can be connected to the surface while running or retrieving from the well (this is made possible by the rotary electrical union) which makes the system able to run tools to "log" the well in realtime.

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments but should be defined only in accordance with the following claims and their equivalents.

What is claimed is:

1. An end cap for sealed attachment to a well tree that is coupled to a wellhead and is configured for a well intervention application comprising:

a cap body having a first closed end and an opposite open end that is for sealingly being coupled to one end of the well tree for closing off the well tree and includes a hollow interior;

a rotatable winch that is disposed within the hollow interior and about which a first cable can be wound; and the winch being coupled to an external part that is configured to rotate the winch and is located external to the cap body;

wherein the first closed end is defined by a top wall that includes a first through hole for receiving a second cable from within the hollow interior and permit routing of the second cable to a location exterior to the cap body;

wherein a load cell is disposed within the hollow interior and is configured to measure tension on the first cable, the second cable being operatively coupled to the load cell and being rotated through the through hole to the exterior of the cap body.

2. The end cap of claim 1, wherein the first cable comprises one of a slickline and an electricline.

3. The end cap of claim 1, wherein the first cable comprises one of a monofilament, a wire, a wireline, a slickline, an electricline, fiber optic, and tubing.

4. The end cap of claim 1, wherein the load cell is connected to a load cell display by the second cable, the load cell display being disposed external to the cap body.

5. The end cap of claim 1, wherein the external part is coupled to the winch through an opening formed in a side of the cap body in a sealed manner.

6. The end cap of claim 5, wherein the external part is coupled to the winch by a magnetic coupling.

7. The end cap of claim 5, wherein the external part is coupled to the winch by a rotary electrical union.

8. The end cap of claim 1, wherein the external part comprises one of a handle and a motor each of which is configured to rotate the winch.

9. The end cap of claim 1, wherein the winch is disposed transversely across the hollow interior and is contained in a winch housing that has a bottom wall with a through hole for receiving the cable from the winch.

10. The end cap of claim 1, wherein the cap body comprises a lubricator and pressured chamber and the hollow interior containing the winch is under pressure and temperature control.

11. A self-contained well lubricator for attachment to a well tree that is coupled to a wellhead and is configured for a well intervention application comprising:

a cap body having a first closed end and an opposite open end that is for sealingly being coupled to one end of the well tree for closing off the well tree and includes a hollow interior;

a rotatable winch that is disposed within the hollow interior and about which a first cable can be wound; and the winch being coupled to an external part that is configured to rotate the winch and is located external to the cap body;

wherein a tool is attached to the first cable and is configured to receive and trap an autonomous sensor ball, wherein the tool comprises a cage frame and a plurality of biased elements that move between a first at rest position and a second extended position in response to an applied force, wherein an inner opening is defined between inner ends of the plurality of biased elements and defines an entrance into an interior of the cage frame, wherein the inner opening has a greater diameter in the second extended position compared to the first at rest position.

12. The lubricator of claim 11, wherein the cage frame has a bottom opening defined by bottom support members of the cage frame and the plurality of biased elements have inner ends that define the inner opening that is spaced upwardly from the bottom opening and defines the entrance into the cage frame, the plurality of biased elements being pivotally attached to the cage frame about the bottom support members and being biased inwardly toward a center of the cage frame.

13. The end cap of claim 12, wherein the second bottom opening has a variable diameter based on a position of the inner ends of the plurality of biased elements.

14. The lubricator of claim 12, wherein each biased element comprises a leaf spring that has a hub that rotates about an axle extending between adjacent bottom support members of the cage frame at the bottom end of the cage frame, each biased element extending upwardly and inwardly from the adjacent support members of the cage frame at the bottom end, the inner ends of the plurality of biased elements being free ends that are free of attachment.

15. A self-contained well lubricator for attachment to a well tree comprising:

a lubricator body having a first closed end and an opposite open end that is for sealingly being coupled to one end of the well tree for closing off the well tree, the lubricator body having a hollow interior that functions as a pressurized chamber;

a rotatable winch that is disposed within the hollow interior;

a first cable wound about the winch; and wherein the winch is coupled to an external part that is configured to rotate the winch and is located external to the lubricator body, the winch being coupled to the external part through a sealed opening formed in a side wall of the lubricator body;

wherein the first closed end is defined by a top wall that includes a first through hole for receiving a second cable from within the hollow interior and routing to an exterior of the lubricator body;

wherein a load cell is disposed within the hollow interior and is configured to measure tension on the first cable, the second cable being operatively connected to the load cell and being rotated through the through hole to the exterior of the lubricator body.

16. The lubricator of claim 15, wherein the first cable comprises one of a slickline and an electricline.

17. The lubricator of claim 15, wherein the external part is coupled to the winch by a magnetic coupling.

18. The lubricator of claim 15, wherein the external part is coupled to the winch by a rotary electrical union.

19. The lubricator of claim 15, wherein the external part comprises one of a handle and a motor each of which is configured to rotate the winch from a location outside the lubricator body.

20. A method for performing a well intervention operation comprising the steps of:

sealingly coupling a lubricator onto an open top end of a well tree, the lubricator having a hollow interior in which a rotatable winch is contained, the winch having a first cable wound thereabout;

attaching a tool to the first cable, wherein the tool comprises a cage frame and a plurality of biased elements that are biased inwardly toward a center of the cage frame;

lowering the tool within a well bore to which the well tree is attached;

capturing an object with the tool as a result of the tool applying a force to the plurality of biased elements causing the plurality of biased elements to pivot outwardly away from the center of the cage frame until the object passes the inner ends of the plurality of biased elements at which time the plurality of biased elements pivot back inwardly to an at rest position; and operating the winch from a location exterior to the lubricator to cause rotation of the winch and winding of the first cable, whereby the tool is retrieved from the wellbore.

21. The method of claim 20, wherein the first cable comprises one of a slickline and an electricline.

22. The method of claim 20, further including the step of: monitoring tension within the first cable using a load cell that is disposed within the hollow interior and is connected to a load cell display by a second cable that passes through a sealed through hole formed in the lubricator body.

23. The method of claim 20, further including an external part that is coupled to the winch by a magnetic coupling, the external part being configured to rotate the winch at the location exterior to the lubricator.

* * * * *